US005516163A

United States Patent [19]

Baker

[11] Patent Number: 5,516,163

[45] Date of Patent: May 14, 1996

[54] SINGLE MOTION, QUICK RELESE LATCH MECHANISM

[76] Inventor: John R. Baker, 845 B Stanley Ave., Evansville, Ind. 47711

[21] Appl. No.: 315,604

[22] Filed: Sep. 30, 1994

[51] Int. Cl.[6] ..... E05C 1/12

[52] U.S. Cl. ..... 292/169; 292/165; 292/170

[58] Field of Search ..... 292/169, 165, 292/170, 168, 169.18, 175, 358

[56] References Cited

U.S. PATENT DOCUMENTS

| | | | |
|---|---|---|---|
| 2,383,574 | 8/1945 | Voight | 292/170 |
| 2,504,483 | 4/1950 | Abraham | 292/174 |
| 3,264,025 | 8/1966 | Hawes | 292/166 |
| 3,655,230 | 4/1972 | Armstrong | 292/169 |
| 3,869,159 | 3/1975 | Eads | 292/170 X |
| 4,101,153 | 7/1978 | Dozier | 292/165 X |
| 4,438,963 | 3/1984 | Friedrich | 292/168 |
| 4,629,228 | 12/1986 | Marko et al. | 292/165 |
| 4,986,583 | 1/1991 | Campbell et al. | 292/336.3 |

*Primary Examiner*—Steven N. Meyers
*Assistant Examiner*—Monica E. Millner

[57] ABSTRACT

A device for operating a linearly activated door latch including exterior and interior knob assemblies connected by a threaded rod. Pushing the exterior knob causes the rod to move towards the door and the cam on the rod will contact the cam follower on the receiver whose tab will rotate the lever to retract the bolt. Once the bolt is retracted and the door is open, a return spring wil bias the bolt back to the extended position.

3 Claims, 4 Drawing Sheets

SINGLE MOTION, QUICK RELESE LATCH MECHANISM

BACKGROUND OF THE INVENTION

1. Field of the Invention

This invention relates to an improved mechanism that, installed in a door, operates by pushing or pulling on the door knob in the direction one is opening or closing the door. This invention also fits in the same space as current door latching mechanisms. The simpler motion combined with the reduced effort to operate and the economy of space, makes this a needed product, especially for the mobility impaired.

2. Description of the Prior Art

A patent search was conducted in Class 292, subclasses 166, 168 and 347, and Class 16, subclass 121. These U.S. Pat. Nos. were discovered:

71,474; Nov. 26, 1867; Evans 100,174; Mar. 13, 1870; Bentley et al 236,895; Jan. 25, 1881; Kirwan 480,075; Aug. 2, 1892; Duncan 2,504,483; Apr. 18, 1950; Abraham 2,532,399; Dec. 5, 1950; Fernandez 2,636,763; Apr. 28, 1953; Chapeta et al 3,249,379; May. 3, 1966; Ross 3,264,025; Aug. 2, 1966; Hawes 4,181,335; Jan. 1, 1980; Thoren This seems to be a crowded field. Of the above, the three most relevant seem to be U.S. Pat. Nos. 236,895 Kirwan, 480,075 Duncan, and U.S. Pat. No. 3,264,025 Hawes. Kirwan's mechanism seems different, and appears to require more effort to actuate. Duncan's mechanism seems different, and also appears to require more effort to actuate. Hawes seems different, more complicated, and bulkier. The effort required by Hawes is reduced by using levers to gain mechanical advantage.

This invention simplifies the process of opening and closing a door. The current invention fits within the space occupied by a convention door latching mechanism that utilizes a rotating motion plus a push or pulling motion. This is important for retrofit installations. This invention reduces the effort, and sometimes pain, by people suffering from wrist pain, arthritis, bursitis, missing fingers, hands or limbs, or other mobility restrictions, when they are opening doors. This invention also makes it easier for small children to exit the room in an emergency situation, such as fire.

The experience of this inventor is that convetional, commercially available door mechanisms, in typical residences, are an obstacle in that the turning motion to operate the door knob is painful and unnecessary. There are no convenient retrofit packages available that simplify the required motion to a push/pull motion. So the present invention was developed, to overcome the aforesaid obstacle. The present invention works with a low push/pull force in the direction of the intended door motion and fits within the confines of existing doors, no door modifications required for installation. The present invention utilizes radii and bushings to lower internal friction which lowers effort. The mechanism designs uncovered in the patent search do not seem concerned with reducing internal friction to lower effort. An indication that the Hawes invention has high internal friction is that levers are required to operate the mechanism.

SUMMARY OF THE INVENTION

Most residential doors swing inward, into a room. The operation of the invention will be described for such installations. One pushes the exterior knob to open a door prior to entering the room. The knob moves towards the door, moving a bar connecting the two door knobs. The bar has a cam, that shifts a receiver, that rotates a lever, that pulls a bolt from a striker plate. There is a spring between the bolt and a receiver, such that when one stops pushing on the knob and removes one's hand, the bolt, the receiver, the lever, the cam, and the door knob all return to their original positions with respect to the door. To shut the door when in the room, one can either push on the knob inside the room, or push on the door, and the door will shut, with the bolt riding over the striker plate in the door jamb and then being pushed into a latching position in the striker plate by action of the aforesaid spring. To open the door, from the inside, one pulls on the knob, and the internal mechanical sequence of action previously described, that resulted from pushing on the exterior knob, repeats. The mechanism travels are short and decisive, with low force required to actuate. The mechanism fits within the spaces required for conventional turn then push or pull door mechanisms. One can replace the mechanism without having to modify or replace the door. The previous state of the art mechanisms uncovered in the patent search above do not seem to both have low internal friction and also to fit within the space requirements of existing conventional turn then push or pull door mechanisms.

DESCRIPTION OF THE PREFERRED EMBODMENT(S)

Figure 2:
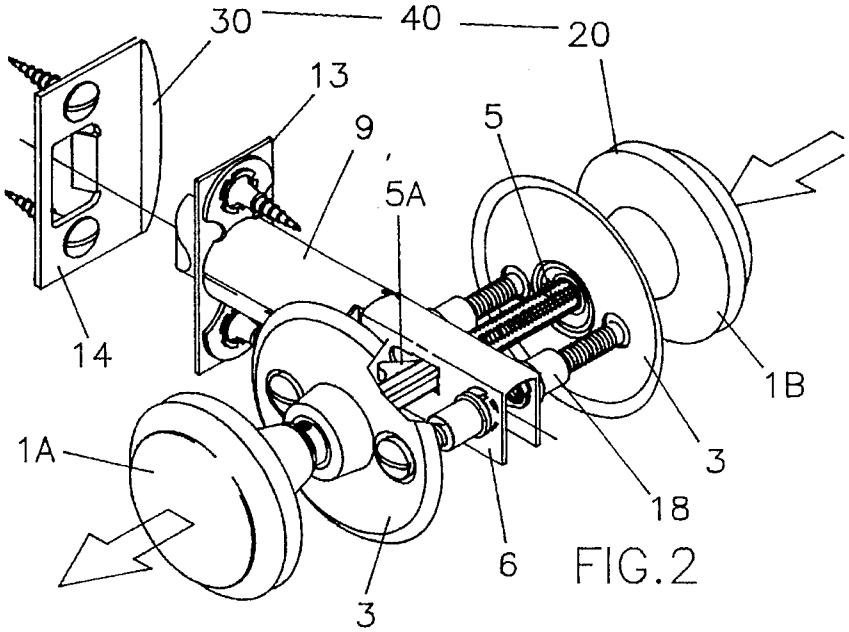
FIG. 2.: Single motion, quick release latch mechanism, at rest, after force has been removed from knob. Knob is at limit of travel in direction shown, with respect to plate. Bolt is engaged in striker plate, adjacent to and abutting the striker plate tang.
Figure 1:
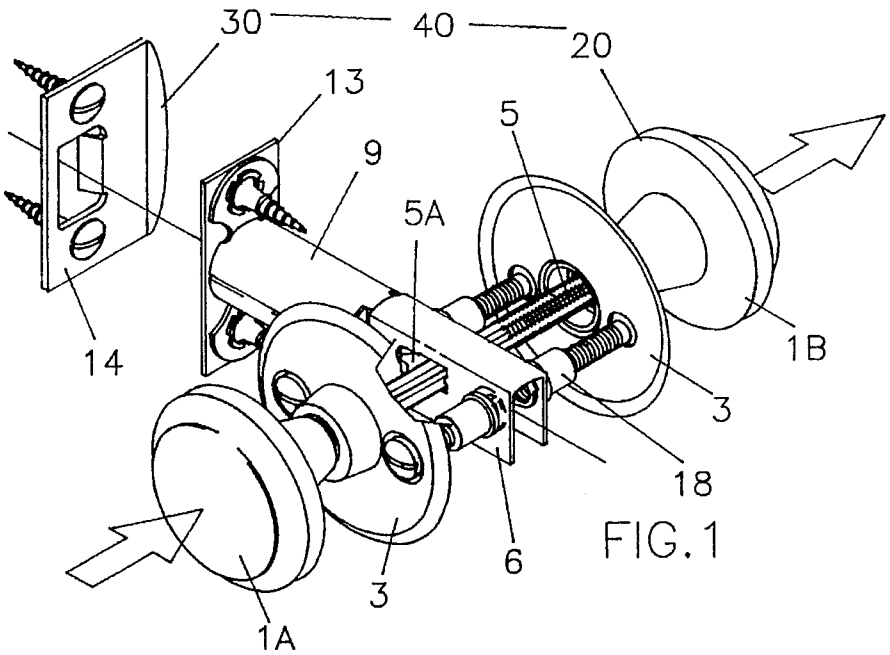
FIG. 1.: Single motion, quick release latch mechanism, as actuated while pushing on exterior knob. Knob is at limit of travel in direction shown, with respect to plate. Bolt is retracted.
Figure 3:
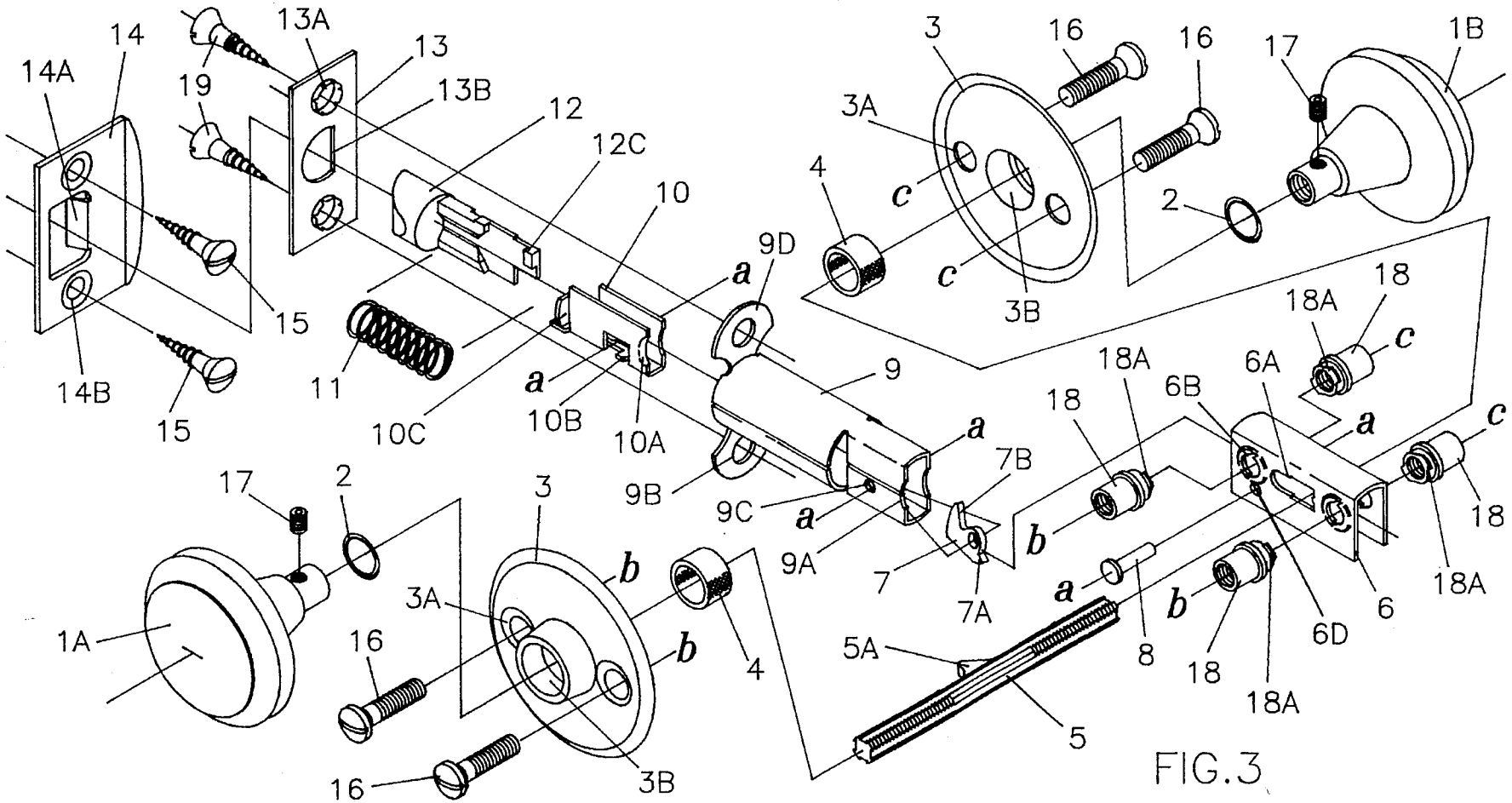
FIG. 3.: Exploded view of single motion, quick release latch mechanism.

Referring to FIG. 1, the single motion, quick release latch mechanism 40, consists of two subassemblies, knob assembly 20 and striker plate assembly 30. FIG. 1 shows the single motion, quick release latch mechanism 40, after the exterior knob 1A has been pushed in the direction shown, to the limit of travel of exterior knob 1A with respect to plate 3. The bolt 12 is withdrawn from the striker plate assembly 30, so that single motion, quick release latch mechanism 40 is in the unlatched condition. When the force in the direction of the arrows shown in FIG. 1 is removed from the exterior knob 1A, the knob assembly 20 immediately returns to the normal, at rest condition, shown in FIG. 2. What this means to the person actuating single motion, quick release latch mechanism 40 is as follows: The person entering the room pushes on the exterior knob 1A in the direction of the arrows shown in FIG. 1. The bolt 12 is retracted, the door opens inward. As the pressure on the knob 1A is released, the knob assembly 20 returns to its at rest condition, as shown in FIG. 2. The person, now in the room, can close the door simply by pushing either on the interior knob 1B or the door. When someone in the room desires to open the door, he or she merely pulls on the interior knob 1B, and the condition shown in FIG. 1 results. As the force pulling the interior knob 1B is relaxed, the knob assembly 20 reverts to the at rest condition as shown in FIG. 2. FIG. 3 illustrates exploded view of the pieces that accomplish the motions shown in FIGS. 1 and 2.

Figure 5:
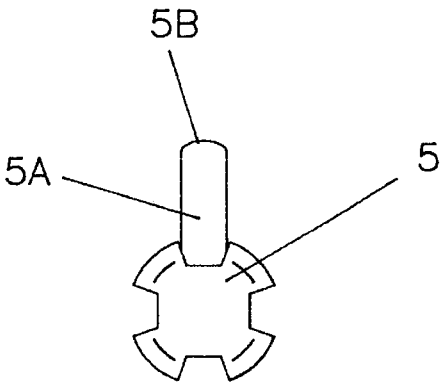
FIG. 5.: End view of bar.
Figure 4:
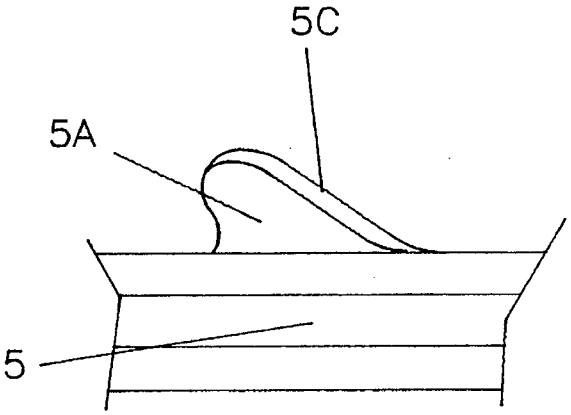
FIG. 4.: Side view of bar.
Figure 8:
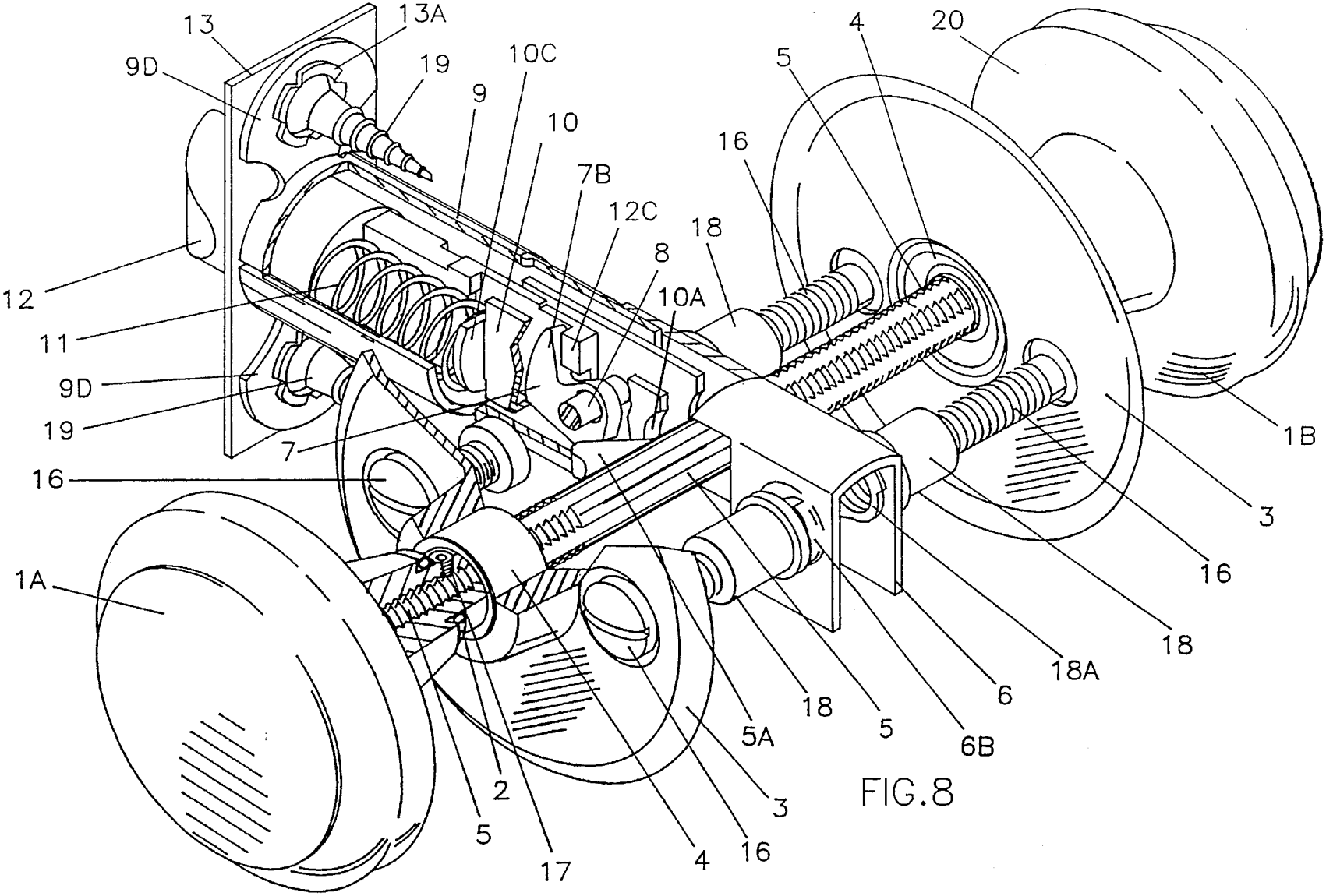
FIG. 8.: A view of the latch shown to illustrate how the cam on the rod moves the receiver which in turn moves the lever to retract the bolt, i.e. the view illustrates how the parts cooperate.

Refer to FIGS. 3 and 8. When pushing on exterior knob 1A, a bar 5, which includes a cam 5A, shifts to the right, said cam 5A also shifting to the right. The cam 5A forces a receiver 10 away from the bar 5, by its action on the receiver cam follower 10A. In the preferred embodiment, the edge of the receiver cam follower 10A that rides on the cam 5A is beveled to reduce both friction and wear. Refer to FIG. 4, for a cam throw 5C illustration. Refer to FIG. 5, for a cam radius 5B illustration. The cam radius 5B on the cam throw 5C reduces the area of contact between the cam 5A and the receiver cam follower 10A when the two are engaged. The cam radius 5B on the cam throw 5C also more precisely locates the location of the area of contact between the cam 5A and the receiver cam follower 10A when the two are engaged. The combination of both the reduced area of contact and the precise location of this area of contact reduces the friction of said contact between the cam 5A and the receiver cam follower 10A when the two are engaged. As the receiver cam follower 10A is a part of a receiver 10, the entire receiver 10 also moves away from the bar 5. The receiver 10 has a tab 10B, which forces a lever lower end 7A to rotate clockwise around a rivet 8, that is inserted through a lever 7, which is contained within both a receiver guide 6, and a barrel housing 9. The lever 7, the receiver guide 6, and the barrel housing 9 are secured by the rivet 8 which passes through a receiver guide aperture 6D and a barrel housing rivet aperture 9C, said rivet 8 serving as the fulcrum for the aforesaid lever 7. Lever 7 contains both the lever lower end 7A and a lever upper end 7B. The rivet 8 secures the lever 7 within the barrel housing 9 and the receiver guide 6 which fits around the barrel housing 9. In the preferred embodiment, the barrel housing 9 and the receiver guide 6 were fabricated as two separate parts for production feasibility. It is obvious to anyone skilled in the art that the housing 9 and the receiver guide 6 could have been fabricated as one part. It is merely a question of tooling investment, quantities required, production economics and similar commercial considerations. The rivet 8 also secures the receiver guide 6, which contains the barrel housing 9, to the barrel housing 9. The lever upper end 7B also rotates clockwise about the rivet 8. The clockwise motion of the upper lever end 7B draws a bolt 12 towards the bar 5, by the camming action of the upper lever end 7B on a bolt lug 12C. There is a spring 11, contained within the barrel housing 9, between the bolt 12 and a receiver spring seat 10C such that when one is no longer pushing on the external knob 1A, the spring forces the bolt 12 returns to its at rest position (as shown in FIG. 2). The spring 11 also forces the spring receiver seat 10C, and thus the receiver 10 to its at rest position. The bolt lug 12C, which is a part of the bolt 12, forces the lever upper end 7B to rotate counterclockwise, so the lever lower end 7A also rotates counterclockwise, while the receiver 10 is also being forced backwards by both the spring and rotation of 7A. The receiver 10 moving to its at rest position, encouraged by both the spring 11 and the rotation of the lower lever end 7A, forces the cam 5A, which in turn forces the bar 5, which inturn shifts the exterior knob 1A back to its at rest position as shown in FIG. 2.

Figure 6:
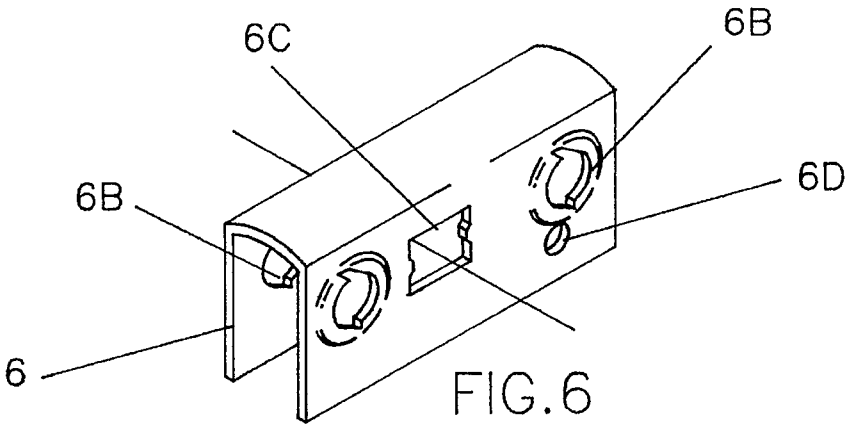
FIG. 6.: Back view of receiver guide.

The bar 5 is externally threaded so the exterior knob 1A and the interior knob 1B which have matching internal threads, can be screwed into position, and secured in place by the set screw 17. The o-ring reduces noise and softens impact. A bushing 4 reduces friction of the exterior knob 1A and also the interior knob 1B sliding through the plate 3. The bushing 4 fits in the plate 3 and contains within itself either the exterior knob 1A or the interior knob 1B, as the case may be. The plate screws 16 go through the plates 3 into the internally threaded spacers 18. The internally threaded spacers 18, have tabs 18A, which rotate and lock into position into spacer receptacle engagements 6B which are a part of the receiver guide 6. The receiver guide 6 also has a receiver guide clearance 6A to permit passage of both the bar 5 and the cam 5A. Receiver guide 6 also has bar guide clearance 6C, as shown in FIG. 6, which both provides clearance and location for the bar 5 with less metal removed from the receiver guide 6 than would have been the case if the receiver guide clearance 6A had been used in the place of clearance 6C.

There is a barrel plate 13 which guides the bolt 12 through a barrel plate receiver 13B. The barrel plate 13 also restricts the motion of the bolt 12 by acting as a stop, stopping the bolt 12 at the point of engagement of a pair of bolt ears 12B with the barrel plate 13.

Figure 7:
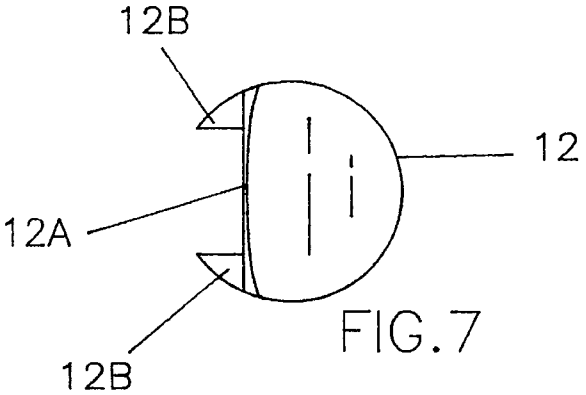
FIG. 7.: End view of bolt.

The striker plate assembly 30 includes a striker plate 14 complete with a striker plate tang 14A and a pair of striker plate screws 15 for securing the striker plate 14 into a door jamb through the countersunk striker plate apertures 14B, at the proper location to mate with the bolt 12 of the door knob assembly 20. This striker plate 14 differs from conventional state of the art striker plates in that the striker plate tang 14A of the present invention in the preferred embodiment is angled so as to provide a line to line contact with a bolt radius 12A, as shown in FIG. 7, when the bolt 12 is engaging the striker plate 14. This line to line contact reduces the force required to move bolt 12 when bolt 12 is engaged with the striker plate tang 14A.

As shown in FIG. 7, the bolt 12, has a radius 12A, that minimizes sliding surface contact with the straight edge of the barrel plate bolt receiver 13B as well as the striker plate tang 14A.

As shown in FIG. 4, the cam 5A, starts with a gradual slope, to minimize force required to actuate the knob assembly 20. In the preferred embodiment, the cam 5A was casehardened to reduce wear.

Referring to FIG. 3, a plate 3, complete with countersunk chamfered clearances 3A, is stationery, held against the door, not shown, by plate screws 16. The plate 3 contains a bushing 4 which contains a portion of the door knob 1A or 1B to reduce friction. The preferred embodiment is teflon, however there are alternative embodiments obvious to anyone skilled in the state of the art to accomplish the same purpose.

The barrel housing 9 includes a clearance 9A for the cam 5A, barrel housing apertures 9B, a pin aperture 9C on both sides, and flanges 9D. The barrel housing 9 is secured in position with respect to the barrel plate 13 by virtue of hollow protrusions 13A as shown in FIG. 3 which fit within the barrel housing aperatures 9B, and can be rolled over the flanges 9D as shown in FIGS. 1 and 2.

Referring to FIG. 1, two barrel plate screws 19 secure the knob assembly 20 in a door, through the barrel plate hollow extrusions 13A, which, as previously stated, fit within the barrel housing apertures 9B.

In the preferred embodiment shown, to minimize internal friction and wear, thus minimizing effort required to actuate, while extending the useful life of the mechanism, appropriate lubrication, including dry film lubricants, iron or tin phosate coatings, teflon coatings, and other means, obvious to those skilled in the state of the art will be utilized on the various points of contact within the single motion, quick release latch mechanism 40.

Although the description above contains many specificities, these should not be construed as limiting the scope of the invention but as merely providing illustrations of some of the presently preferred embodiments of this invention. For example, while the invention is primarily intended for doors, it is also applicable to gates, drawers, and a variety of other types of closures or places where a quick release mechanism with low actuating force is desirable.

Thus the scope of the invention should be determined by the appended claims and their legal equivalents, rather than by the examples given.

I claim:

1. A door latch with a bolt translating between retracted and extended postions mounted in a recess in a door with an exterior and interior surface cooperating with a strike plate in the extended position mounted in a recess in a frame comprising:

an exterior knob mounted on the exterior surface of said door with a threaded end extending into the recess of the door;

an interior knob mounted on the interior surface of said door with a threaded end extending into the recess of the door;

a rod with threaded ends and a centrally located cam wherein the rod extends through the recess in the door and is threadedly attached to the exterior and interior knob ends;

a receiver with a cam follower and a tab wherein the receiver is actuated by the cam when the exterior knob linearly translates towards the exterior surface of said door causing the bar to shift whereby the cam will contact the cam follower of the receiver;

a lever with upper and lower ends mounted to a receiver guide and a barrel housing by a rivet wherein the receiver guide has clearances and is affixed to the barrel housing and guides said bolt and the barrel housing guides said receiver and bolt and wherein the tab on the receiver will rotate the lever lower end clockwise causing the lever upper end to rotate to contact a lug on the bolt to retract the bolt from the strike plate;

plates with plate screws affixing said plates to internally threaded spacers having tabs which lock spacer receptacle engagements in said receiver guide;

a pair of bushings connected to said exterior and interior door knobs wherein the pair of bushings are contained within the plates;

a return spring contained within the barrel housing between the bolt and the receiver; and a barrel plate with mounting screw wherein the barrel plate limits bolt travel.

2. The door latch of claim 1, wherein the barrel plate includes hollow extrusions attached to the barrel housing wherein the hollow extrusions fit within flange apertures of the barrel housing.

3. The door latch of claim 1, further including resilient O-rings between the exterior and interior knobs and corresponding mounting plates to limit noise.

* * * * *